US008517292B2

(12) United States Patent
Chang

(10) Patent No.: US 8,517,292 B2
(45) **Date of Patent: *Aug. 27, 2013**

(54) PARTICLE SEPARATOR

(76) Inventor: Jin-Hong Chang, Hsin Ying (TW)

( * ) Notice: Subject to any disclaimer, the term of this patent is extended or adjusted under 35 U.S.C. 154(b) by 272 days.

This patent is subject to a terminal disclaimer.

(21) Appl. No.: 13/005,317

(22) Filed: Jan. 12, 2011

(65) Prior Publication Data

US 2012/0175446 A1 Jul. 12, 2012

(51) Int. Cl.
*B02C 21/00* (2006.01)
*B02C 23/10* (2006.01)

(52) U.S. Cl.
USPC ..... 241/56; 241/79.1

(58) Field of Classification Search
USPC ..... 241/79, 79.1, 56; 209/28, 29, 138, 209/139, 139.2, 710, 713
See application file for complete search history.

(56) References Cited

U.S. PATENT DOCUMENTS

| | | | | |
|---|---|---|---|---|
| 3,372,805 | A * | 3/1968 | Lykken et al. | 209/135 |
| 5,238,196 | A * | 8/1993 | Chang | 241/56 |
| 6,318,559 | B2 * | 11/2001 | Cordonnier et al. | 209/154 |
| 7,118,055 | B2 * | 10/2006 | Chang | 241/79.1 |
| 7,913,851 | B2 * | 3/2011 | Chang | 209/139.2 |

* cited by examiner

*Primary Examiner* — Faye Francis
(74) *Attorney, Agent, or Firm* — Pro-Techtor Int'l Services

(57) ABSTRACT

A particle separator comprises: a driving shaft and two support rings, mounted on the driving shaft, having a plurality of mounting holes, a plurality of blades, having far ends to which two holding rods are attached to be inserted in the plurality of mounting holes, so that the plurality of blades are allowed to sway while being mounted on the support rings, wherein the mounting holes of the support rings are arranged in a quantity that is a divisible number, so that, when the blades are installed, any divisor of said quantity of mounting holes serves as a guide for a number of mounting holes between mounted blades.

5 Claims, 7 Drawing Sheets

PARTICLE SEPARATOR

FIELD OF TILE INVENTION

The present invention relates to a particle separator for use in a grinding mill, particularly to a particle separator for use in a grinding mill.

DESCRIPTION OF RELATED ART

With increasing quality of life, demands on industrial products have become stricter. In particular, food and medical products have become subjected to environmental standards. The GMP standard regulates grinding mills as to (1) ingredients, (2) noise, (3) iron contents (resulting from wear), (4) heat, and (5) pollution. Meeting those standards is an urgent requirement.

Conventionally, grinding mills are designed according to the following five considerations: (1) torque, (2) centrifugal force, (3) grinding force, (4) heat, and (5) noise. Besides, separators for grinding mills are designed for effectiveness of separating various particle sizes, with the ability to grind out tine particles being decisive. Conventional separators do not effectively separate desired tine front yet too coarse particles, hence resulting in decreased grinding effectivity and in a lack of capability to meet demands for thoroughly refining particles.

U.S. Pat. No. 7,118,055 discloses an upright pressure type mill with separator. Therein a separator has a plurality of blades rotating at high speed generating air flow vortices, which take along particles that are suspended in air, whereas relatively coarse particles are by centrifugal force driven outward and fall into a grinding mill to be ground again, so that only relatively fine particles are separated and collected by the separator.

That kind of separator of the grinding mill effectively sorts particles according to coarseness and fineness thereof. However, for controlling or adjusting sizes of separated particles, the force of air flow for suspending particles has to be adjusted or the rotational speed of the blades has to be regulated. But, independent from whether force of air flow or rotational speed of blades are adjusted, due to hydrodynamic calculations, precise parameters are hard to obtain and instabilities happen easily.

The present inventor has deliberated on that and devised a separator for a grinding mill that allows for easy adjusting of sorted particle sizes, so that convenience of operating grinding mill separators is increased.

SUMMARY OF THE INVENTION

The main object of the present invention is to provide a particle separator which is easy to operate and precisely adjustable for sizes of sorted particles, mainly comprising two support rings, mounted at upper and lower positions on a driving shall, and a plurality of blades, mounted along a periphery of the support rings. The support rings have a plurality of mounting holes and the blades each have on a side close to the support rings several holding rods to be quickly inserted into the mounting holes, so that the plurality of blades are allowed to sway while being mounted on the support rings. The mounting holes of the support rings are arranged in a quantity that is a divisible number, so that the blades are installed with any divisor of said quantity of mounting holes being the distance of any two neighboring blades, when inserted into the mounting holes, allowing a user quickly to adjust number and mutual distance of blades installed on the support rings, while the blades are evenly distributed along the support rings.

The present invention can be more fully understood by reference to the following description and accompanying drawings.

DETAILED DESCRIPTION OF THE PREFERRED EMBODIMENTS

Figure 1:
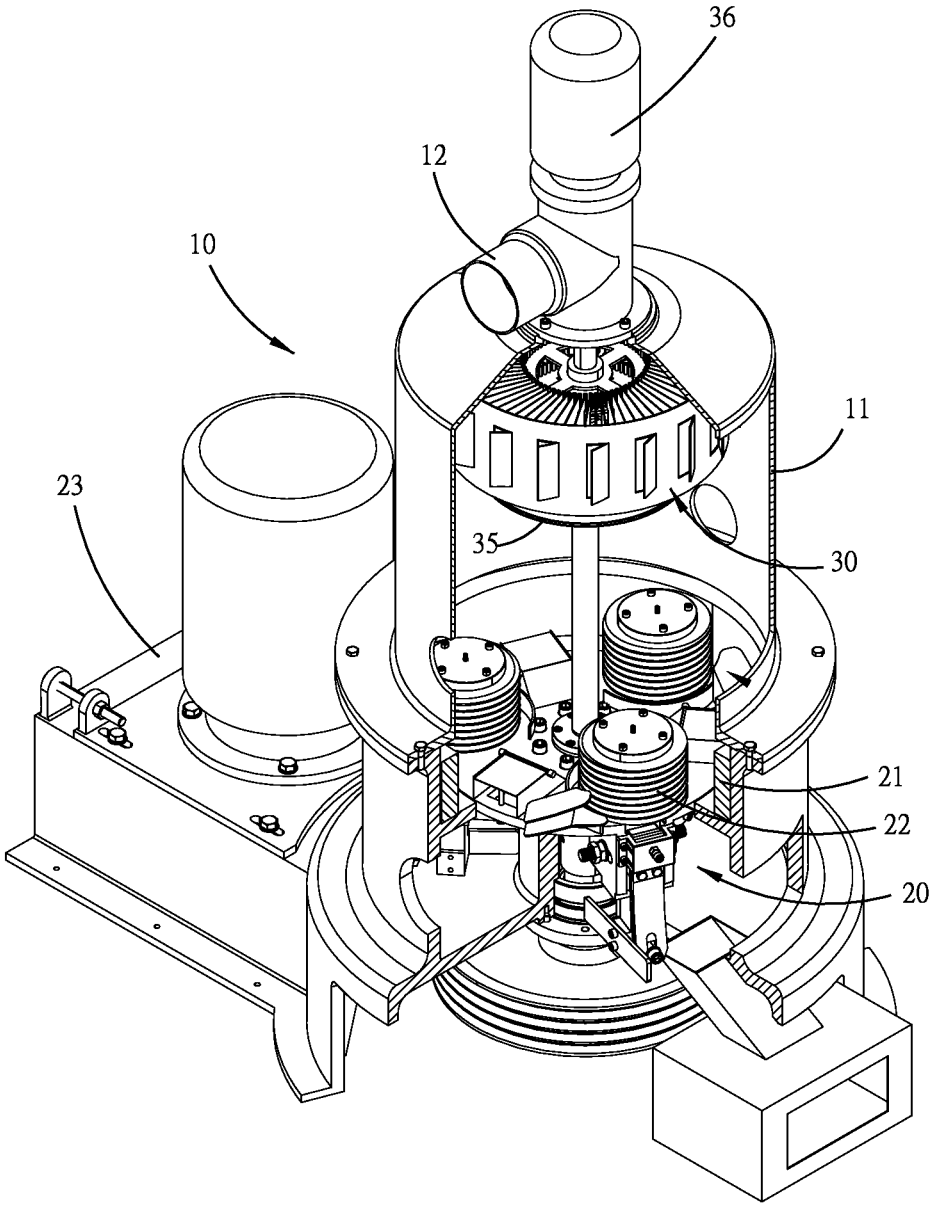
FIG. 1 is a perspective view of a grinding mill with the separator of the present invention.
Figure 2:
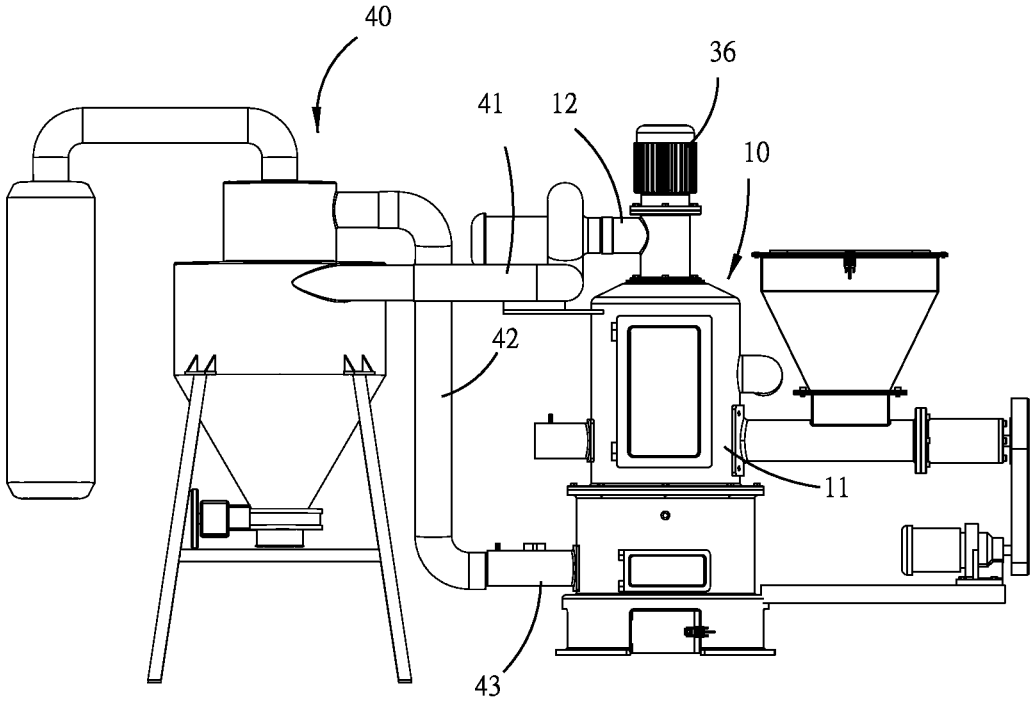
FIG. 2 is a schematic illustration of a complete grinding mill apparatus with the separator of the present invention.

FIGS. 1 and 2 show the separator of the present invention mounted on a grinding mill. The grinding mill 10 is a vertically oriented grinding mill, having a cylindrical main body 11, a grinding device 20, which is mounted at a lower section of the main body 11 and a separator 30, which is installed in an open space at a top end of the main body 11.

As shown in FIG. 2, the main body 11, at the top end thereof, has an air outlet 12, connected with a collecting apparatus 40, where the collecting apparatus 40 has an air drawing tube 41 for connecting with the aft outlet 12, allowing to suck out air at the top end of the main body 11 of the grinding mill 10 through the air outlet 12. Particles ground by the grinding mill are sucked into the collecting apparatus 40 and collected there. The collecting apparatus 40 further has an air tube 42 for connecting to a drum fan 43 at a lower end of the main body 11.

Figure 3:
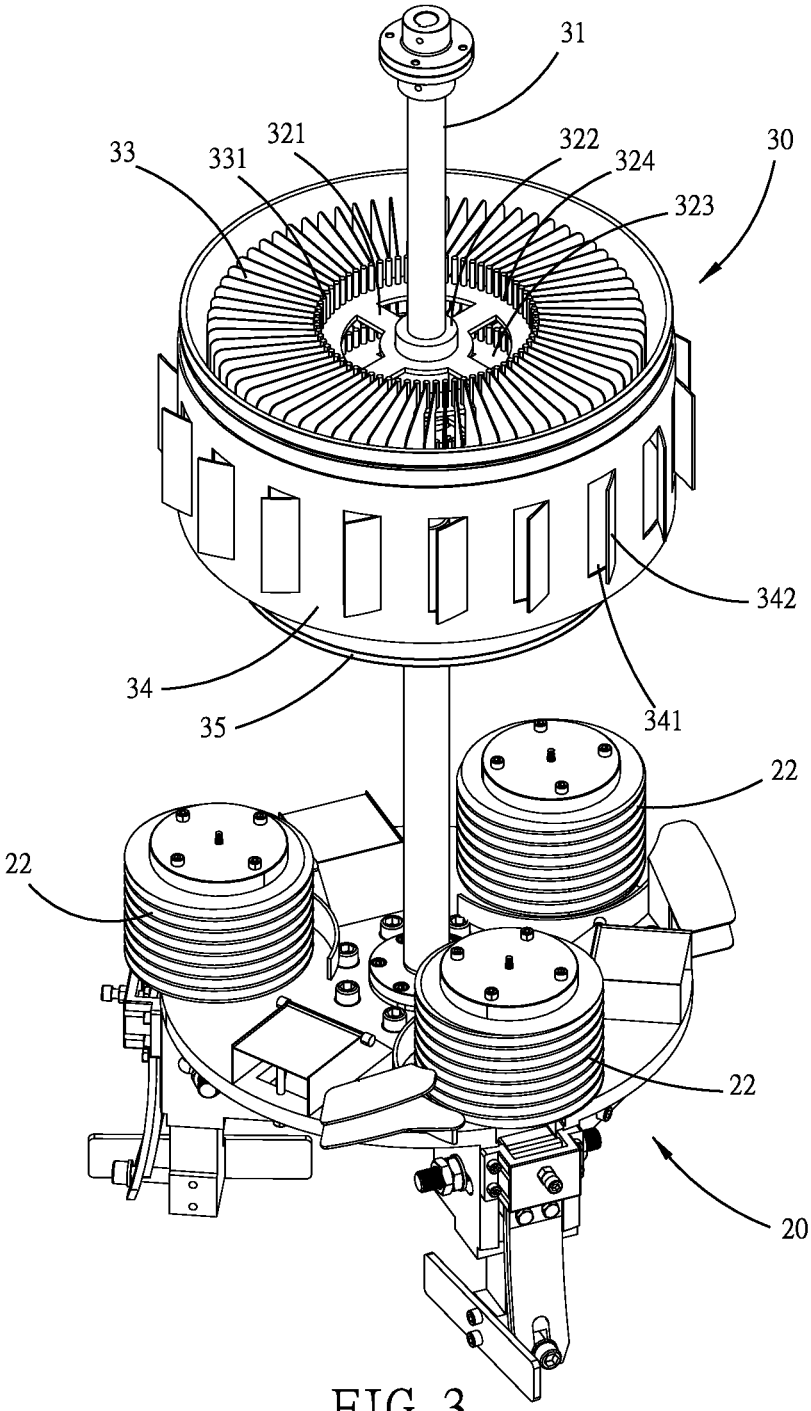
FIG. 3 is a perspective view of a grinding device with the separator of the present invention.

As shown in FIGS. 1 and 3, the grinding device 20 mainly comprises an outer grinding wheel 21 and several inner grinding wheels 22, placed at an inner surface of the outer grinding wheel 21, and a rotating driving device 23.

When the grinding device 20 is started, the drum fan 43 of the collecting apparatus 40 starts simultaneously, blowing air into a lower space in the main body 11, which is subsequently sucked out from the air outlet 12 at the top of the main body 11, so that an upward flow of air within the main body 11 is generated. The rising air flow takes particles ground by the grinding device 20 through the separator 30, letting particles that have been ground down to a predetermined diameter pass through the separator 30 to be collected in the collecting apparatus 40, whereas particles which have not yet been ground finely enough are sorted out by the separator 30 and fall back into the grinding device 20 to be ground anew.

Figure 4:
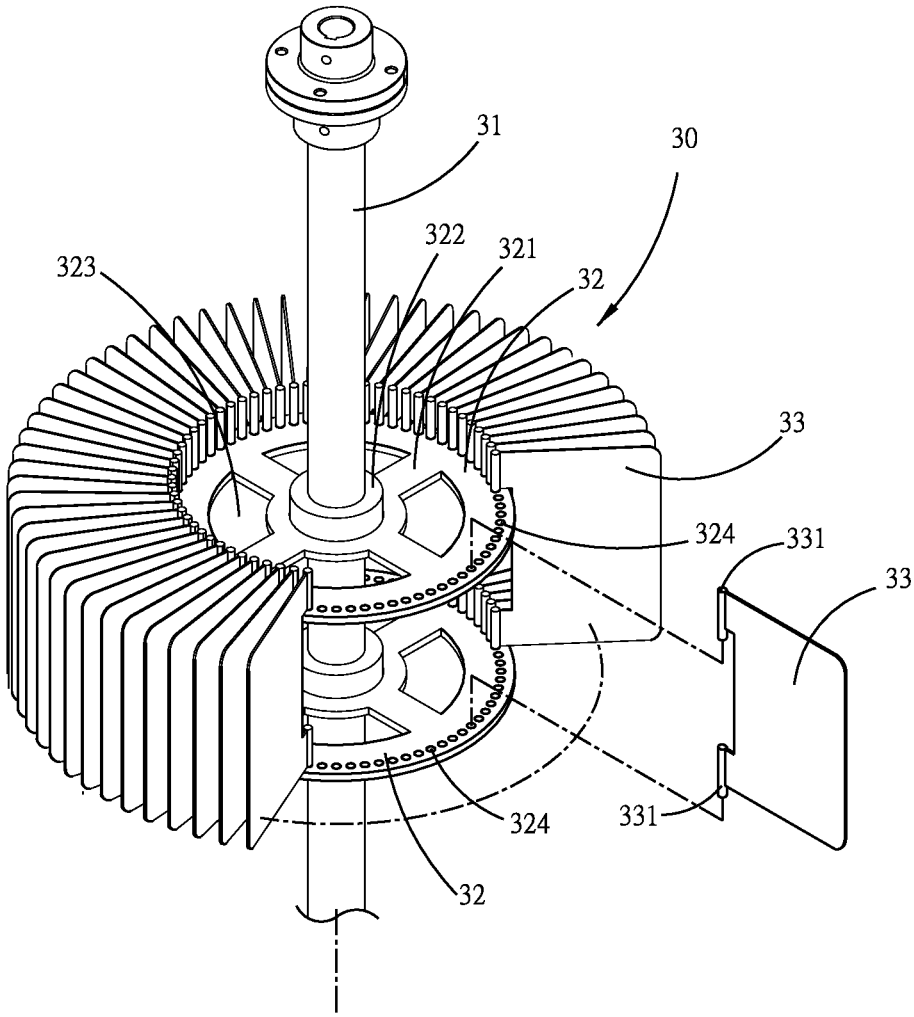
FIG. 4 is a perspective view or the separator of the present invention in a partly disassembled state.
Figure 5:
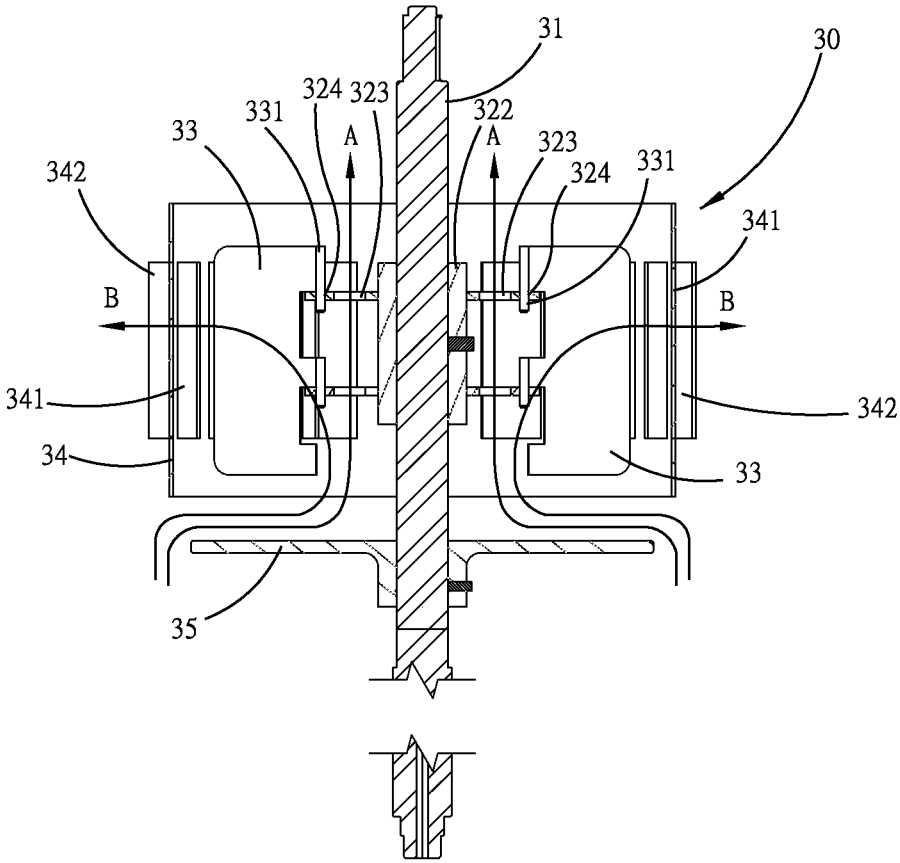
FIG. 5 is a sectional view of the separator or the present invention.

Referring to FIGS. 1, 4 and 5, the separator 30 of the present invention comprises: a driving shaft 31, mounted on a central axis of the main body 11, with a driving device 36 on the top side of the main body 11 driving a rotational movement of the driving shaft 31; two support rings 32, set an the driving shalt 31 at upper and lower vertical positions and in parallel orientations; a plurality of vertical blades 33, arranged circularly and held by the two support rings 31 and, rotationally driven by the driving shaft 31 and the support rings 32, generating a vortex in the air flow within the separator; a guiding drum 34 of cylindrical shape, surrounding the plurality of blades 33; and a plated-shaped adjusting disc 35, having an adjustable vertical position, mounted on the driving shaft 31 below the plurality of blades 33 and the guiding drum 34.

Figure 6:
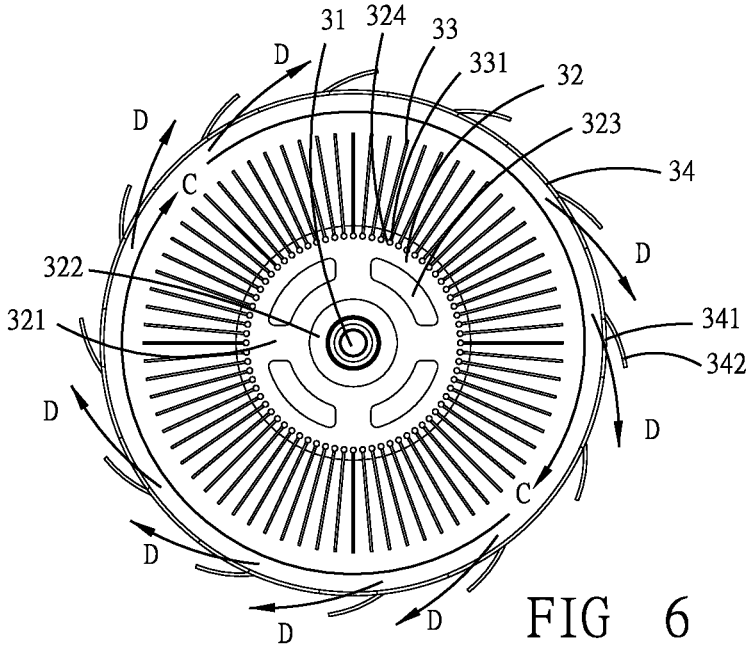
FIG. 6 is a top view of the separator of the present invention with all blades being mounted.

Referring to FIGS. 3 and 6, the guiding drum 34 surrounds a periphery of the plurality of blades 33, having a plurality of openings 341, which are of longitudinal shape and oriented parallel to the plurality of blades 33, respectively, and a plurality of guiding plates 342, respectively attached to the guiding drum 34 at plurality of openings 341. As shown in FIG. 6, the plurality of guiding plates 342 are oriented along the vortex lines generated by the rotational movement of the plurality of blades 33 (in the Fig. indicated by arrows C), being attached to one side of the plurality of blades 33, respectively, and inclined from a peripheral surface of the guiding drum 34 outward and towards a side away from the air flow vortex. Hence the direction of inclination roughly accords to the direction C of the centrifugal direction of the circulating air flow, taking particles in the air flow that is hurled outward by the centrifugal force of the circulating air flow along to pass through the plurality of openings 341.

Referring to FIGS. 4 and 6, the support rings 32 at centers thereof have shaft sleeves 322 for mounting on the driving shaft 31 as well as several spokes 321, radially extending inward. Each of the spokes 321 has a free end connected to one of the shaft sleeves 322, which have smaller diameters than inner peripheries of the support rings 32, with the shaft sleeves 322 being used for mounting thereof on the driving shaft 31. The inner periphery of the support rings 32, the outer side of the shaft sleeves 322 and the outer sides of each or the spokes 321 together leave open various openings in the shape of sectors, through which air flows.

As shown in FIG. 5, when the grinding mill rotates, the rising air flow, used to take along particles, passes in an upward direction through the separator 30. While the air flow passes through the separator 30, the plurality of blades are driven by the driving shaft 31 and the support rings 32 at high rotational speed. Hence, when passing through the separator 30, the air flow is deflected by the blades, developing a vortex at a high rotational speed.

Due to the vortex generated by the plurality of blades 33, a centrifugal force results, driving particles from a vertical center outward. As is known to the inventor, underpressure increases when the vertical center is approached, hence particles that are taken along by the circular air flow are the lighter, the closer the particles are located to the vertical center, whereas, the further away located from the center (that is, the closer to the periphery), the heavier particles are. Therefore, as long as an ascending force is greater than weight, particles will float and be drawn away by air (indicated in FIG. 5 by arrows A). Relatively heavy (coarse) particles are pulled outward by air flow, through the openings 341 in the guiding drum 34 (indicated in the Fig. by arrows B), subsequently entering the grinding device to be ground anew.

The main characteristic of the separator 30 of the present invention lies in the ability of the blades 33 to be replaced quickly and to sway while mounted on the support rings 32. Furthermore, the support rings 32 each have a plurality of mounting holes 324 for mounting the blades 33 of a non-prime number. Thus by varying the number of blades 33 in the mounting holes 324, various mutual distances of blades 33 for mounting on the support rings 32 are realized.

Therefore, a user is enabled to adjust number and density of blades 33 for controlling particle sizes, while blades are uniformly distributed around the support rings 32.

As shown in FIGS. 4 and 5, fastening of each of the blades 33 of the present invention is performed by two vertically oriented holding rods 331, which are respectively placed close to the upper and lower ends of one side of the support rings 32. Each of the holding rods 331 is shaped like a cylinder, having a lower end which extends downward from a connecting part of one of the blades 33. On the upper and lower support rings 32, along peripheries thereof, the mounting holes 324 are arranged.

As shown in FIG. 5, the mounting holes 324 on the two support rings 32 are arranged around centers that are aligned and, for each of the blades 33, the two holding rods 331 are aligned along a common axis and have a mutual distance that is about equal to the distance between the two support rings 32. Thus the blades 33, having been inserted into the mounting hakes 324 of the upper and lower support rings 32, are allowed to sway around the holding rods 331, respectively, on the two support rings 32.

Referring again to FIG. 5, as to the support rings 32 and the blades 33, due to the weights of the blades 33, the holding rods 331 remain inserted in the mounting holes 324, without any other means of fastening being required. Hence mounting and dismounting of the blades 33 is performed simply by inserting and removing of the holding rods 324 from the mounting holes 324, so that the object of quick replacing of blades 33 is achieved.

Furthermore, for flexible adjusting of number and density of the blades 33 on the support rings 32, while maintaining uniform mutual distances of blades 33, the mounting holes 324 are distributed around the support rings 32 at equal angular distances and the number of mounting holes 324 is a divisible number, so that, when the separator 30 is adjusted to a different number and density of blades 33, based on the mutual distances of the mounting holes 324 as units, serving as distances between neighboring blades 33, the number and density of blades 33 is flexibly adjusted, while weight balance is maintained with the blades 33 being mounted on the support rings 32.

A sample calculation of the number of mounted blades and mounting holes is as follows.

The sample table takes 42 holes as an example and demonstrates how to calculate the distances between blades 33. As shown in the table, the number 42, according to arithmetic, is factored as 2×3×7. The divisors of 42 are 1, 2, 3, 6, 7, 14 and 21.

TABLE 1

Blade mounting distances for a number of holes of 42

| Number of blades | Blade distance (divisor) | Holes between neighboring blades |
|---|---|---|
| 42 | 1 | 0 |
| 21 | 2 | 1 |
| 14 | 3 | 2 |
| 7 | 6 | 5 |
| 6 | 7 | 6 |
| 3 | 14 | 13 |
| 2 | 21 | 20 |

When the number and density of blades 33 is modified, the divisors from above Table 1 are taken as the distances between blades 33. For example, if 42 blades are to be mounted on the support rings, the divisor 1 as distance of mounting is obtained, so that between any two blades 0 holes are left. If, if 21 blades are to be mounted, the divisor 2 as distance of mounting is obtained, so that between any two blades 1 holes are left. If, it 14 blades are to be mounted, the divisor 3 as distance of mounting is obtained, so that between any two blades 2 holes are left. The remaining blade numbers and distances are easily obtained from the table.

Furthermore, as shown in Table 2, if the support rings 32 have 72 mounting holes 324, then by factoring the number 72 as $2^3 \times 3^2$, the divisors, besides 1 and 72 itself, are 2, 3, 4, 6, 8, 12, 18, 24 and 36.

Thus, for mounting the blades 33, the numbers and distances for inserting blades in the support rings 32 are obtained from the following table.

| Number of blades | Blade distance (divisor) | Holes between neighboring blades |
|---|---|---|
| 72 | 1 | 0 |
| 36 | 2 | 1 |
| 24 | 3 | 2 |
| 18 | 4 | 3 |
| 12 | 6 | 5 |
| 9 | 8 | 7 |
| 8 | 9 | 8 |
| 6 | 12 | 11 |
| 4 | 18 | 17 |
| 3 | 24 | 23 |
| 2 | 36 | 35 |

Referring to FIG. 6, in an embodiment in which the two support rings 32 each have 72 mounting holes 324, the divisors from Table 2 are taken as the distances between blades 33 on the support rings 32.

Thus, when a user plans to modify the number and density of blades 33, the sequence of divisors obtained from the number of mounting holes 324 guide the distances between neighboring blades 33.

Figure 7:
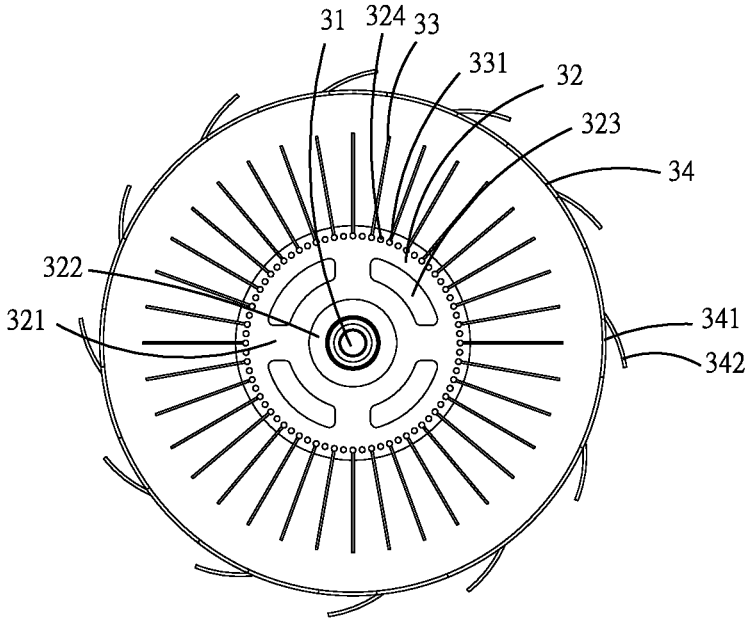
FIG. 7 is a top view of the separator of the present invention with 36 blades being mounted.
Figure 8:
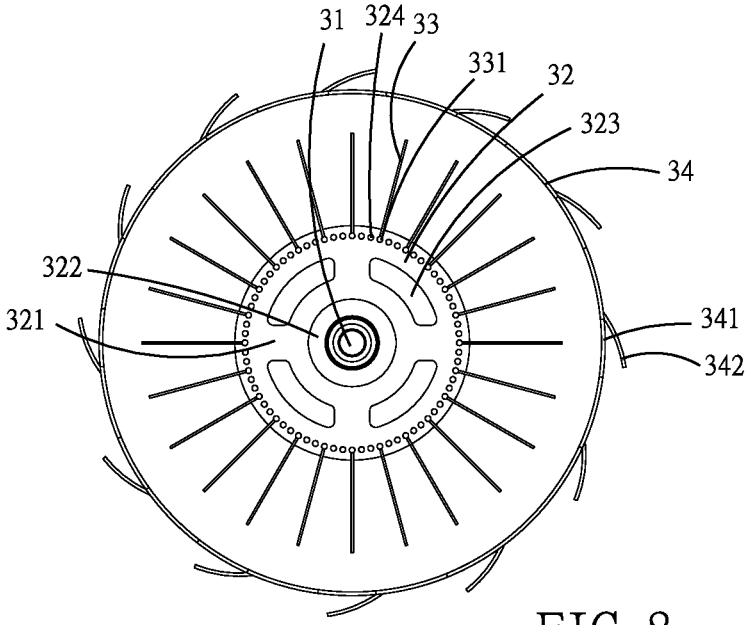
FIG. 8 is a top view of the separator of the present invention with 24 blades being mounted.
Figure 9:
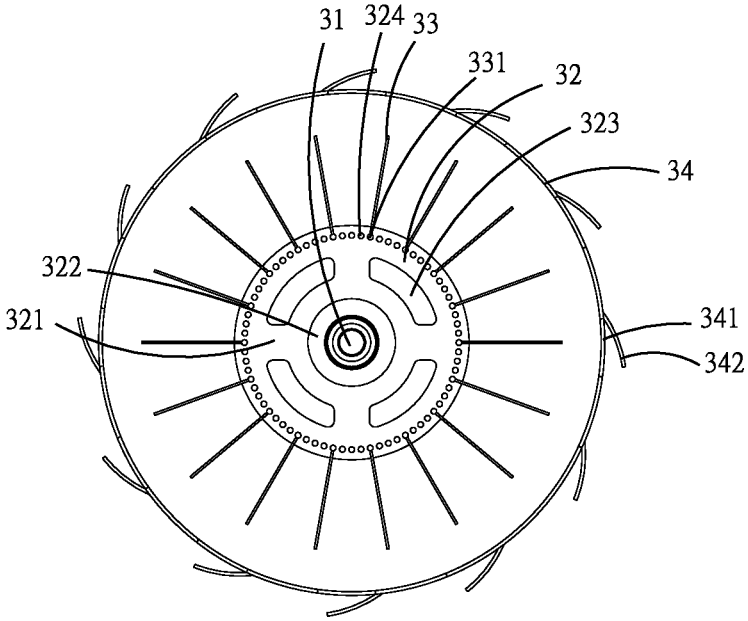
FIG. 9 is a top view of the separator of the present invention with 18 blades being mounted.

In above embodiment, the table allows to judge quickly on various combinations of inserting blades 33, along with various blade numbers and installations. For example, if 36 blades 33 are to be mounted, the divisor 2 as distance of mounting of blades 33 is obtained, so that between any two blades 1 holes are left (as shown in FIG. 7). If 24 blades 33 are to be mounted, the divisor 3 as distance of mounting of blades 33 is obtained, so that between any two blades 2 holes are left (as shown in FIG. 8). If 18 blades 33 are to be mounted, the divisor 4 as distance of mounting of blades 33 is obtained, so that between any two blades 3 holes are left (as shown in FIG. 8). If 12 blades 33 are to be mounted, the divisor 6 as distance of mounting of blades 33 is obtained, so that between any two blades 5 holes are left (as shown in FIG. 9). The remaining blade numbers and hole numbers are easily obtained and are not further explained.

The higher the number of blades 33 mounted on the support rings 32 is (the denser the blades 33 are arranged), the stronger the vortex generated by rotating of the blades 33 is, and consequently the centrifugal force thereof. Thus the rising air flow in the central axis of the blades 33 contains a relatively large amount of outward extracted air, reducing the flow through the center of the support rings 32, resulting in finer separated particles.

On the other hand, with a relatively small number of blades 33 being mounted on the support rings 32, the generated vortex is weaker, increasing the flow through the center of the support rings 32, which takes along relatively coarse particles, resulting in coarser separated particles.

Therefore, the present invention allows, by adjusting the number of blades 33 mounted on the support rings 32, to control the degree of fineness of separated particles. Given the number of mounting holes 324 on the support rings 32, a user, for mounting the blades 33, easily calculates the number of holes between neighboring blades 33, avoiding a non-uniform distribution of blades, which would result in uneven rotation, vibrations, imprecise rotation and even damages.

The present invention provides a particle separator which is flexibly arrangeable and controllable as to fineness of separated particles, while being easy to use.

The invention claimed is:

1. A particle separator for use in conjunction with a grinding mill, for sorting ground particles according to sizes thereof, comprising:

a driving shaft;

two upper and lower support rings, which are mutally aligned and of circular shapes, being fixedly connected to a shaft sleeve at a center thereof, said shaft sleeve being mounted on said driving shaft; and a plurality of spokes, extending inward from said support rings, wherein, by connecting said plurality of spokes and said shaft sleeve, a plurality of openings is left between inner sides of said support rings and said spokes, allowing air to pass through;

characterized by said two support rings having a plurality of mounting holes close to peripheral edges thereof; and a plurality of blades, each mounted on peripheries of said two support rings, having on one side close to said support rings two aligned rotational axes and two holding rods, which are oriented perpendicular to said two support rings, said two holding rods being inserted into said plurality of mounting holes, allowing said plurality of blades to sway when mounted on the support rings; and said mounting holes of said support rings being arranged in a quantity that is a divisible number, so that, when said blades are installed, any divisor of said quantity of mounting holes serves as a guide for a number of mounting holes between mounted blades;

wherein particles ground in said grinding mill pass, carried by an air flow, through said blades and an air flow vortex, brought about by said blades causes relatively large and heavy particles to undergo a centrifugal force and to be pulled outward, so that an object of separating particles is achieved.

2. The particle separator according to claim 1, wherein, said holding rods of said plurality of blades have lower ends which project from lower edges of said blades, so that, after being inserted in said mounting holes of said two support rings, said holding rods are held by weights of said plurality of blades in said plurality of mounting holes.

3. The particle separator according to claim 1, further comprising:

a guiding drum of cylindrical shape, surrounding an outer side of said plurality of blades and having a plurality of openings, with an inclined guiding plate being attached to one side of each of said openings.

4. The particle separator according to claim 3, wherein said grinding mill is installed at a lower side of said separator, so that a rising air flow carries particles ground in said grinding mill upward to pass through said separator.

5. The particle separator according to claim 4, further comprising:

an adjusting disc, shaped like a circular plate and mounted on said driving shaft at an adjustable vertical position, placed at a lower side of said plurality of blades and said guiding drum, allowing to adjust a quantity of air flow entering said separator from said lower side thereof.

* * * * *